US005319830A

United States Patent [19]

Stäheli

[11] Patent Number: 5,319,830

[45] Date of Patent: Jun. 14, 1994

[54] CLEANING MACHINE FOR TEXTILE FIBERS

[75] Inventor: Paul Stäheli, Wilen, Switzerland

[73] Assignee: Maschinenfabrik Rieter AG, Winterthur, Switzerland

[21] Appl. No.: 673,303

[22] Filed: Mar. 22, 1991

[30] Foreign Application Priority Data

Mar. 23, 1990 [CH] Switzerland ..... 967/90

[51] Int. Cl.[5] ..... D01G 9/20

[52] U.S. Cl. ..... 19/205; 19/200

[58] Field of Search ..... 19/85, 200, 202, 203, 19/204, 205, 95, 65 R

[56] References Cited

U.S. PATENT DOCUMENTS

| | | | |
|---|---|---|---|
| 2,738,557 | 3/1956 | Anderson et al. | 19/205 |
| 4,258,455 | 3/1981 | Werner | 19/200 |
| 4,397,065 | 8/1983 | Bettoni et al. | 19/200 |
| 4,797,976 | 1/1989 | Leifeld et al. | 19/200 |
| 4,964,196 | 10/1990 | Schmid et al. | 19/200 |
| 4,969,237 | 11/1990 | Schmid | 19/200 |

FOREIGN PATENT DOCUMENTS

| | | | |
|---|---|---|---|
| 379726 | 8/1990 | European Pat. Off. | 19/204 |
| 3425666 | 1/1986 | Fed. Rep. of Germany . | |
| 3615416 | 11/1987 | Fed. Rep. of Germany . | |
| 2603907 | 3/1988 | France . | |
| 266628 | 7/1970 | U.S.S.R. | 19/200 |
| 279878 | 12/1970 | U.S.S.R. | 19/202 |
| 2210908 | 6/1989 | United Kingdom . | |

*Primary Examiner*—Clifford D. Crowder
*Assistant Examiner*—Michael A. Neas
*Attorney, Agent, or Firm*—Burns, Doane, Swecker & Mathis

[57] ABSTRACT

A fiber cleaning machine has a horizontal roller (1) fitted with beater rods (4, 5). Bar grates (4, 5) are arranged under the lower side of the roller. Over the upper side of the roller (1), an inlet (9) opens out at one end of the roller (1), and an outlet (10) opens out at the other end for a current of delivery air for transporting the fibers in flock form. Between the inlet (9) and the outlet (10), sheet metal deflectors (11) are arranged obliquely over the upper side the roller (1) to provide transfer chambers which move the current of delivery air in the direction of the axis of the roller (1). Cooperating with the transfer chambers is a partition (30) which is permeable to air and dust and which is a wall of a low-pressure chamber (20). Not only can coarser impurities be separated through the bar grates (4, 5), but also finely divided impurities may pass through the permeable partition (30) into the low-pressure chamber (20) where they are sucked into a suction pipe (15).

15 Claims, 1 Drawing Sheet

CLEANING MACHINE FOR TEXTILE FIBERS

FIELD AND BACKGROUND OF THE INVENTION

The invention relates to a type of textile fiber cleaning machine in which fibers are transported in a current of delivery air adjacent the periphery of a horizontal roller fitted with beater elements. Grate bars are arranged beneath the roller. An inlet for the current of delivery air is provided above and near one end of the roller periphery and the stream goes spirally around the roller to an outlet at the other end.

Such cleaning machines serve the purpose of opening the fiber flocks which are delivered in the current of delivery air to remove the impurities therefrom. The fiber material is pulled over the bar grate and is also beaten, to a degree, through the impact with partitions in the vicinity of the roller so that impurities are released from the material. Larger impurities (fragments of seed husks, for example) penetrate through the bar grate and are then sucked away. Finer, finely divided impurities, however, remain at least partly in the current of delivery air in the known machines and leave such machines together with the fiber material discharged in the current of delivery air.

SUMMARY OF THE INVENTION

According to an aspect of the present invention a cleaning machine of this type is equipped in such a way that it can also substantially intercept finely divided impurities from the fiber material. In an embodiment of the invention, an air and dust permeable member or partition is provided adjacent the flow path at the periphery of the beater roller. This partition is preferably substantially vertical, and at least a portion of it is positioned so that it is exposed to a zone in the flow path which is in front of the bar grate arrangement in the conveying direction of the textile fibers. The permeable partition is a boundary or part of a low-pressure chamber, to which a suction pipe is connected.

Air can be sucked through the air and dust permeable partition to separate the very light, finely divided particles of dirt from the fiber material being transported in the current of delivery air adjacent the beater roller.

The air and dust permeable partition may be a sheet screen, for example, or a perforated sheet with holes of about 1.5 mm diameter. Preferably, means are provided for adjusting the amount by which the pressure in the low-pressure chamber is depressed below the pressure in the current of delivery air.

BRIEF DESCRIPTION OF THE DRAWINGS

Exemplary embodiments of cleaning machines according to the invention will be more fully explained below with reference to the accompanying drawings, in which.

DETAILED DESCRIPTION OF PREFERRED EMBODIMENTS

Figure 1:
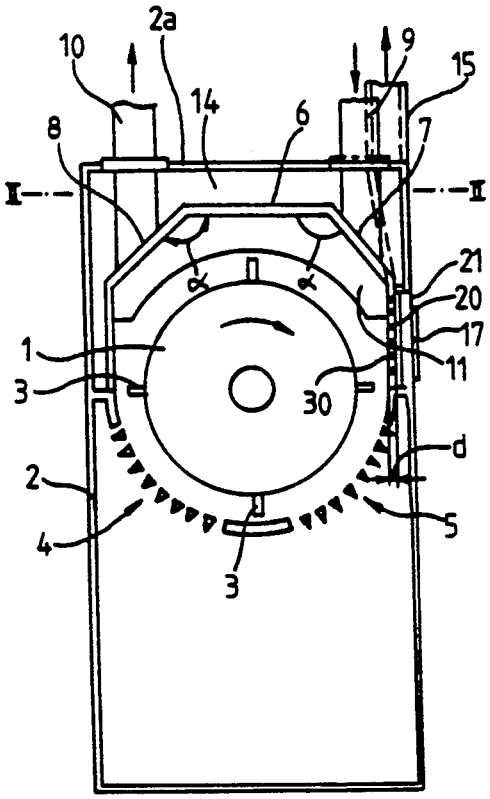
FIG. 1 is a schematic vertical section through a coarse cleaning machine.
Figure 3:
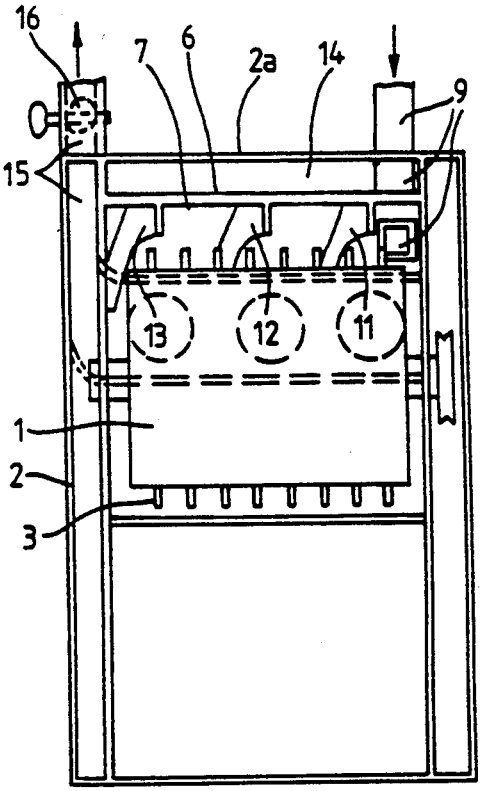
FIG. 3 is a vertical section of the machine of FIG. 1 looking in a direction at right angles to FIG. 1.
Figure 2:
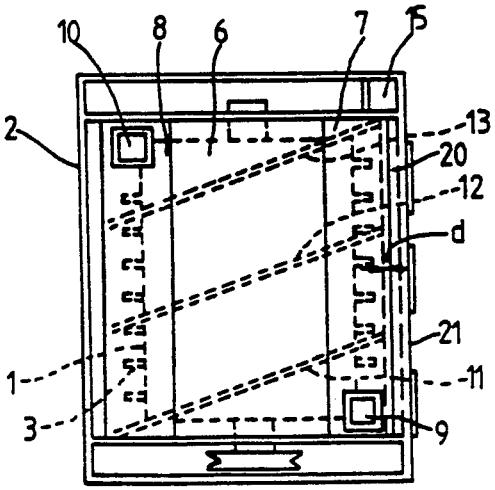
FIG. 2 is a top view along the section line II—II in FIG. 1.

The coarse cleaning machine represented in FIGS. 1–3 has a beater in the form of an opening roller 1 which is rotatable on a horizontal axis in a housing 2 and which has beater rods 3 fitted to its periphery in a conventional way. In operation, the roller 1 is rotated by a drive motor (not shown) in the direction of the arrow in FIG. 1.

Two bar grates 4 and 5 are arranged below the underside of the roller 1. These are shown only in FIG. 1.

The upper side of the roller 1 is covered with a partition having a clearance from the periphery of the roller. The partition includes a horizontal central section 6 and two lateral sections 7 and 8 connecting to the central section and being inclined at angles of about 45°. The three partition sections 6, 7 and 8 are arranged as a cover. In the FIG. 1 cross section, the sections 7 and 8 form sides of approximately equal length and each of them intersects the central section or roof 6 an angle alpha of about 135°.

A substantially vertical partition 30 which is permeable to air and dust is provided adjacent to the partition 7. The partition 30 is, for example, formed by a perforated sheet with holes of about 1.5 mm diameter or by a sheet screen. The whole surface of the air and dust permeable partition 30 is part of a low-pressure chamber 20 to which a suction pipe 15 is connected.

A fiber transport system is provided for conducting the inlet 9 opens out from above at one end of the roller 1. An outlet 10 opens out at the other end of the roller 1. Between the openings of the inlet 9 and the outlet 10, there are three sheet metal deflectors 11, 12, 13 over the upper side the roller 1. These deflectors are below the partition sections 6, 7, and 8 and are arranged obliquely to the axis of the roller 1. Together with the partition sections 6, 7, and 8, they define two transfer chambers above the upper side of the roller.

In operation, the textile fibers to be cleaned and opened are fed in the form of flocks through the inlet 9 in a first flows substantially around the underside of the rotating roller 1, then through the transfer chamber between the sheet metal deflectors 11 and 12, which deflect the air further in the passes around the underside of the roller and through the direction of the grip of the roller 1. Then the flow again transfer chamber between the sheet metal deflectors 12 and 13. Then the flow again passes round the underside of the roller 1, in order to leave the machine finally through the outlet 10. With the circulation around the underside of the roller 1, the fiber flocks are acted on by the beater rods 3 and opened progressively and impurities are separated from the fibers. The coarser impurities, such as fragments of husk, for example, are separated through the bar grates 4 and 5, and are sucked out of the space under the bar grates by a suction arrangement which is not shown.

After each exposure to the beating action accomplished as the fibers are worked against the grate bars, the fiber flocks fly upwards for a time into a subsequent transfer chamber, where they are further opened and turned through impacts on the partition sections 6, 7, 8. Fine, finely divided impurities, which are separated from the fibers, can at best only be sucked out partially through the bar grates 4 and 5, whilst a large part of the dust remains in the delivery current of air. The air and dust permeable partition 30, the low-pressure chamber 20, and the suction pipe 15 serve the purpose of separating the fine impurities from the current of delivery air, so that they do not emerge through the outlet 10 at the end with the delivery air and the fibers. The suction pipe 15 is connected to a low-pressure chamber, not shown, or a suction device, which sucks the dust laden air through the partition 30.

The degree of pressure reduction provided for the low-pressure chamber (or the magnitude of the current of air sucked through the partition 30) preferably is adjustable. For example, the low-pressure source of the suction device may be schematically illustrated butterfly valve 16, may be arranged in the suction pipe 15. The current of air is set so that it is sufficient to suck the dust out of the pipe 15 and so that the dust is not deposited on the underside of the low-pressure chamber. In order to be able to observe this, observation windows 17 are provided in the outer wall 21, e.g., as shown in the drawings.

Furthermore, at least one scavenging air inlet 18 preferably is arranged in the low-pressure chamber 20, so that scavenging air from the surroundings can be sucked into the low-pressure chamber 20. The scavenging air inlet 18 likewise may contain an adjustable throttling element, e.g. a butterfly valve 19 (FIG. 4).

The inside of the air and dust permeable partition 30, is always kept clean through the fiber flocks transported in the current of delivery air. If the partition 30 is perforated, then the holes on the inside (that is, the side facing the beater 1) of the partition should not have any burrs, so that no fibers or impurities can catch on these sharp edges. The partition 30 desirably can be formed from a perforated sheet which is galvanized on the inside. The coating then extends—when the surface is rounded—in some measure into the holes.

Figure 4:
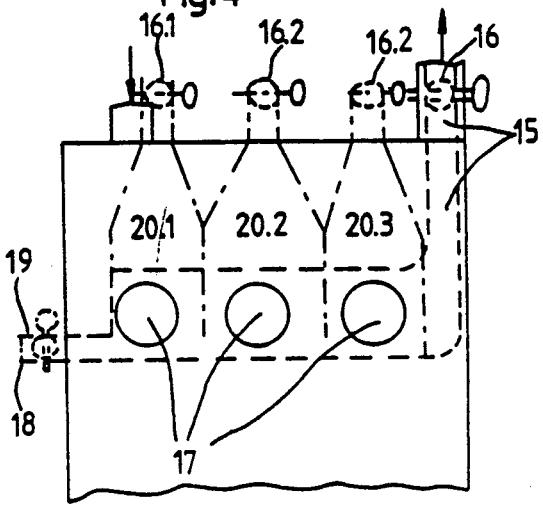
FIG. 4 is a partial section similar to FIG. 3 but showing features of a different embodiment of coarse cleaning machine according to the invention.

In the embodiment in FIG. 4, the low-pressure chamber 20 is divided into more than one low-pressure chamber. For example three low-pressure chambers 20.1, 20.2 and 20.3 are provided, and a suction pipe with a butterfly valve is assigned to each low-pressure chamber. The butterfly valves are designated with 16.1, 16.2 and 16.3. The division has the advantage that the air current per section can be more uniform than is the case when a single suction is applied, as shown in connection with FIGS. 1-3, across substantially the entire length of the roller 1.

The low pressure chambers 20.1, 20.2 and 20.3, as shown in FIG. 4, can have the fresh air inlet opening or the scavenging air inlet opening 18 assigned to the same scavenging air opening with the butterfly valve 19, so that a fresh air entry to all three chambers is possible. It is also possible to connect a scavenging air pipe with an appropriate throttling valve of its own to each chamber.

Finally, it is desirable in some instances to select the thickness d of the partition 30 in such a way that this partition section will, when in operation, be set in vibration through the impact of the fiber material transported in the current of delivery air.

What is claimed is:

1. Cleaning machine for textile fibers transported in a current of delivery air, with a horizontal roller (1) fitted with beater elements (3), on the underside of which grate bars (4, 5) are arranged and above its upper side, an inlet (9) is arranged at one end and to one side of the roller and at the other end, an outlet (10) for the current of delivery air, wherein there is provided in front of the bar grate arrangement (4, 5) in the conveying direction, a substantially vertical partition (30) which is permeable to air and dust, which is part of a low-pressure chamber (20) on which a suction pipe (15) is fastened, and which is placed at the same side of the roller as said inlet (9) so that a portion of said current of delivery air entering said inlet (9) may pass directly through said permeable portion 30.

2. Cleaning machine according to claim 1, including means (16) for setting the magnitude of the under pressure in the low-pressure chamber (20).

3. Cleaning machine according to claim 2, wherein said setting means comprises at least one adjustable throttling member.

4. Cleaning machine according to claim 3, wherein said adjustable throttling member is a butterfly valve.

5. Cleaning machine according to claim 1, wherein the low-pressure chamber (20) contains at least one observation window (17) through which the current of delivery air is visible in front of said air and dust permeable partition (30).

6. Cleaning machine according to claim 1, wherein said low-pressure chamber (20) has at least one air inlet (10) for the admission of scavenging air into the low-pressure chamber (20).

7. Cleaning machine according to claim 6, wherein an adjustable throttling member is arranged in said scavenging air inlet (18).

8. Cleaning machine according to claim 7, wherein said adjustable throttling member is a butterfly valve.

9. Cleaning machine according to claim 1, wherein said air and dust permeable partition (30) is formed by a perforated sheet provided with a galvanic deposit on the side acted on by the textile fibers.

10. Cleaning machine according to claim 1, wherein said air and dust permeable partition (30), is limited by terrace type partition sections (6, 7, 8) of which any two include an angle (alpha) of preferably 135°.

11. Cleaning machine according to claim 1, wherein said air and dust permeable partition (30) has a thickness (d) such that the partition (30) can be set in vibration through the impact of the fiber material transported in the current of delivery air during operation of the machine.

12. Fiber cleaning apparatus comprising a housing including a top wall provided at one end portion thereof with an inlet through which a downwardly directed stream of air and fibers to be cleaned passes; a horizontal beater rotatably mounted in said housing beneath said inlet with its axis of rotation out of vertical alignment with said inlet so that said stream passes over a downwardly moving peripheral portion of said beater at one end of said beater; a fiber transport system for delivering fibers to be acted upon by said beater through said inlet and for later removing fibers from the zone of action of said beater; a grate positioned below said beater and having openings therein through which coarse foreign material may be separated from the fibers being treated; a substantially vertical air dust permeable member between said inlet and said grate and facing said downwardly moving peripheral portion of said beater so that a portion of the air in said stream from said inlet may pass directly through said permeable member before contacting said grate; and means for creating a low pressure on the side of said permeable member opposite to said beater to draw air and dust from the zone adjacent the beater; said fiber transport system including means for flowing a conveying air stream including fiber into said housing above one end and at the periphery of said beater, means for flowing a conveying air-stream out of said housing at a location above an opposite end of said beater, and guide means above the upper periphery of said beater for guiding an air stream flowing within said housing in a direction having axial and circumferential components.

13. Fiber cleaning apparatus according to claim 12, wherein the length of said air and dust permeable member is substantially the same as the length of said beater.

14. Fiber cleaning apparatus according to claim 13, wherein said means for creating low pressure is operable to create different low pressures at different zones along the length of said air and dust permeable member.

15. Fiber cleaning apparatus according to claim 12, wherein said guide means includes three wall surfaces intersecting one another at an angle of about 135° and extending lengthwise of said beater in a zone above the beater and, vertical partitions mounted between said wall surfaces and the periphery of said beater and being arranged at an angle to the axis of the beater, and wherein said air and dust permeable member intersects one of said wall surfaces at an angle of about 135°.

* * * * *